US008087408B2

(12) United States Patent
Reischmann et al.

(10) Patent No.: US 8,087,408 B2
(45) Date of Patent: Jan. 3, 2012

(54) SAFETY SYSTEM FOR A STOVE

(75) Inventors: Michael Reischmann, Eustis, FL (US); Phillip Williams, Clinton, CT (US)

(73) Assignee: Kenyon International, Inc., Clinton, CT (US)

( * ) Notice: Subject to any disclaimer, the term of this patent is extended or adjusted under 35 U.S.C. 154(b) by 304 days.

(21) Appl. No.: 12/247,640

(22) Filed: Oct. 8, 2008

(65) Prior Publication Data

US 2009/0090345 A1 Apr. 9, 2009

Related U.S. Application Data

(60) Provisional application No. 60/978,594, filed on Oct. 9, 2007, provisional application No. 60/986,763, filed on Nov. 9, 2007.

(51) Int. Cl.
*F24C 15/30* (2006.01)
*A47G 29/02* (2006.01)

(52) U.S. Cl. ..... 126/24; 248/125.8; 219/447.1

(58) Field of Classification Search ..... 248/407, 248/125.8, 125.9, 188.5; 219/447.1; 126/214 D, 126/42, 211, 376.1, 299 D, 24; 52/101
See application file for complete search history.

(56) References Cited

U.S. PATENT DOCUMENTS

| | | | | |
|---|---|---|---|---|
| 1,645,466 | A | 10/1927 | Westlake | |
| 2,155,425 | A * | 4/1939 | La Mere | 219/447.1 |
| 3,198,189 | A | 8/1965 | Oatley | |
| 3,469,870 | A * | 9/1969 | Barkus | 403/107 |
| 3,515,116 | A * | 6/1970 | Finnstrand | 126/24 |
| 3,586,824 | A | 6/1971 | Barney | |
| 4,203,416 | A | 5/1980 | Simpson et al. | |
| 6,037,572 | A | 3/2000 | Coates et al. | |
| 7,556,034 | B2 * | 7/2009 | De Miranda Grieco | 126/211 |
| 2007/0277802 | A1 * | 12/2007 | Reed et al. | 126/42 |

FOREIGN PATENT DOCUMENTS

GB 798376 7/1958

* cited by examiner

*Primary Examiner* — Kenneth Rinehart
*Assistant Examiner* — Chuka C Ndubizu
(74) *Attorney, Agent, or Firm* — St. Onge Steward Johnston & Reens LLC

(57) ABSTRACT

A system for improving the safety of a stove by preventing unwanted movement of cooking vessels in use on the stove. The system includes independently extendable posts that are adjacent to the cooking areas of the stove. The extendable posts may be retracted to a position wherein the top surface of the post is at or below the surface of the stove so as to enable easy cleaning and provide an attractive appearance. The posts are easily moved between their extended and retracted positions and are biased upwardly.

19 Claims, 14 Drawing Sheets

SAFETY SYSTEM FOR A STOVE

CROSS-REFERENCE TO RELATED APPLICATIONS

The present application claims the benefit under 35 U.S.C. §119(e) of the U.S. Provisional Patent Application Ser. No. 60/978,594, entitled Safety System for a Stove, filed Oct. 9, 2007, and Provisional Patent Application Ser. No. 60/986,763, entitled Release Mechanism for Safety System for a Stove, filed Nov. 9, 2007. The entirety of all prior applications is incorporated by reference herein.

FIELD OF THE INVENTION

The present invention relates to a device and system for preventing or at least minimizing unwanted movement of a cooking vessel on a stove. In particular, the present invention relates to a pop-up device and safety system for use with a portable or built-in stove.

BACKGROUND OF THE INVENTION

The use of portable or built-in cooking appliances—such as stoves—is widespread in most parts of the world. Portable or built-in stoves are commonly used while camping, boating, sailing, traveling by RV, or performing similar activities to make meal preparation more convenient. Many individuals desire a small portable or built-in stove for preparing meals while in transit or in a location that is remote from any stationary kitchen. Nearly everyone uses a stationary built-in stove in their home or business.

A "built-in" stove generally refers to a stove that is installed in a counter or table in a house, restaurant, truck, boat, or other vehicle. A "portable" stove generally refers to a stove that is adapted to be carried by hand and may be installed in a carrying case. Portable stoves are often used for camping.

Meal preparation in a moving vehicle like a boat or truck brings significant danger that a cooking vessel being used on the stove may slide and create a spill or other dangerous condition. Similar dangers exist in cases when a stove is used on an uneven or excessively soft surface, such as may be encountered while camping. Even in a home or commercial kitchen—particularly during extremely busy meal times—there is a significant danger of accidental movement of a cooking vessel while in use.

The dangers associated with unwanted movement of cooking vessels while in use are well known in the art. For example, in U.S. Pat. No. 3,515,116 to Finnstrand, a vertically-adjustable utensil holder is described for use with a stove. The utensil holder includes, for each burner of the stove, a shaft mounted in a sleeve on the stove. The shafts each support a pair of arms, which wrap around a cooking vessel to help prevent unwanted movement of the cooking vessel. The system of Finnstrand is, however, as is apparent from the figures, complicated, bulky, unsightly, difficult to use, and difficult to clean.

U.S. Patent Appl. Pub. No. 2007/0277802 of Reed et al. discloses a cookware safety device. In one embodiment, locking arms are raised and lowered by a motorized element. The locking arms are raised and lowered simultaneously by a single driveshaft. When in the lowered position, the arms are disclosed to be hidden beneath the stovetop surface. Unfortunately, the system of Reed is expensive to implement and to maintain because of its complexity. Further, the system of Reed provides very little flexibility regarding the size of the cooking vessel that is usable with the safety system, since the entire structure must be raised or lowered. The system has no capability to raise only one arm while leaving other arms hidden beneath the stovetop surface.

What is needed, therefore, is a safety system for a stove that is simple to operate and cheap to manufacture and install. The system must provide a clean and attractive appearance and the system must not impede efficient cleaning of the stovetop surface. The system must be simple to maintain and repair. The system must easily accommodate cooking vessels of varying size.

SUMMARY OF THE INVENTION

It is an object of the present invention to provide a safety system for a stove that is simple and inexpensive to manufacture, install, and/or replace.

It is a further object of the present invention to provide a safety system that contributes to a clean and tidy appearance for a stove.

It is another object of the present invention to provide a safety system for a stove that is easy to clean.

It is yet another object of the present invention to provide a safety system for a stove that is easy to use.

It is still another object of the present invention to provide a safety system for a stove that easily accommodates cooking vessels of varying size.

These and other objects are achieved by provision of a first embodiment of the present invention, comprising an apparatus for reducing unwanted movement of a cooking vessel, that includes a stovetop surface having an opening and a retractable post. The post has an extended position in which a top surface associated with the post is elevated above the stovetop surface and a retracted position in which the top surface is at or below the stovetop surface. The post is biased into the extended position and the retracted position.

In some embodiments, the post is moved from the extended position to the retracted position and from the retracted position to the extended position by first moving the post into a recessed position, in which the top surface is lower than in the retracted position. In some embodiments, the post is biased by a spring element.

In some embodiments, the apparatus further comprises a cylindrical housing in which the post is slideably disposed and which is mounted in the opening and a clicker rod rotatably disposed in the housing, supporting the post and having a plurality of rails, each rail having a top canted surface. The spring element pushes upward on said clicker rod which in turn pushes upward on said post and the canted surfaces and the force of the spring cause the clicker rod to rotate a selected discrete amount when the post is moved into the recessed position.

In some embodiments, the post has a plurality of protrusions adjacent its lower edge and a zig-zag pattern on its lower edge that engages the canted surfaces of the plurality of rails. Further, the cylindrical housing has a plurality of grooves formed on its inside surface for engagement with the protrusions of the post and the rails of the clicker rod, the grooves comprising closed grooves, having their lower ends closed, alternating with open grooves, having their lower ends open. The rails, with each discrete rotation, alternate between abutting against the closed grooves to establish the retracted position and sliding into the open grooves to establish the extended position.

In some embodiments, the cylindrical housing includes a threaded portion on its outside surface for engagement with threads on the stovetop surface. In some embodiments, the threads are formed on a collar that is attached to the stovetop surface. In some embodiments, the cylindrical housing includes two protrusions for engagement with ledges formed on a collar that is attached to the stovetop surface.

In some embodiments, the apparatus further comprises a bumper formed of a heat resistant elastomeric material attached to the top portion of the post, on which the top surface is disposed and which contacts the cooking vessel.

The foregoing objects are also achieved by provision of a second embodiment of the present invention, comprising a system for reducing unwanted movement of at least one cooking vessel on a stovetop, which includes: a stovetop surface having a cooking area and a plurality of openings proximate the cooking area and a plurality of retractable posts, each disposed in one of the plurality of openings. Each post has an extended position and a retracted position, such that when each post is in the extended position, a top surface of the post is elevated above the stovetop surface such that the post may contact at least one cooking vessel and when the post is in the retracted position, the top surface of the post at or below the stovetop surface. Each post is movable between its extended position and retracted position independently of any other post.

In some embodiments, each post is moved from the extended position to the retracted position and from the retracted position to the extended position by moving the post into a recessed position, in which the top surface of the post is below the stovetop surface. In some embodiments, each post is biased in the extended and retracted positions.

In some embodiments, each post is slideably disposed in a cylindrical housing, each of which is mounted in an opening in the stovetop surface. A clicker rod is rotatably disposed in each housing, supporting each post and having a plurality of rails, each rail having a top canted surface and the spring force pushes upward on the clicker rod which in turn pushes upward on the post. Further, the canted surfaces and the force of the spring cause the clicker rod to rotate a selected discrete amount when the post is moved into the recessed position.

In some embodiments, each post has a plurality of protrusions adjacent its lower edge and a zig-zag pattern on its lower edge that engages the canted surfaces of the plurality of rails. Each cylindrical housing has a plurality of grooves formed on its inside surface for engagement with the protrusions of each post and the rails of each clicker rod, the grooves comprising closed grooves, having their lower ends closed, alternating with open grooves, having their lower ends open. The rails, with each discrete rotation, alternate between abutting against the closed grooves to establish the retracted position and sliding into the open grooves to establish the extended position.

In some embodiments, the top surface is on an elastomeric bumper disposed on the top of the post, and the bumper contacts the at least one cooking vessel. In some embodiments, the stovetop surface comprises three openings disposed equidistant from one another in a triangle around the cooking area, and a retractable post is disposed in each opening. In some embodiments, the cooking area is a first cooking area and the stovetop surface further comprises a second cooking area, and wherein the stovetop surface comprises five openings disposed around the cooking areas, and wherein a retractable post is disposed in each opening.

In some embodiments, each post is supported by an expandable chamber which is connected to a fluid source, and the post is moved from the retracted position to the extended position as a result of an increase in pressure within the expandable chamber. In some embodiments, the system further comprises a plurality of electric motors, wherein each electric motor is used to move one of the plurality of posts back and forth between the retracted position and the extended position.

In some embodiments, the top surface of the post has substantially the same size and shape of the opening in the stovetop surface, such that when the post is in the retracted position, the stovetop surface and the top surface of the post form a substantially continuous plane.

According to a third embodiment of the present invention, a device for mounting in an opening in a stovetop surface for reducing unwanted movement of a cooking vessel is provided. The device comprising: a retractable post, having a zig-zag pattern on its lower edge and a plurality of protrusions adjacent the lower edge; a clicker rod, supporting the post and having a plurality of rails, each rail having a top canted surface that engages the zig-zag pattern of the lower edge of the post; a spring, providing an upward force on the clicker rod and the post; and a cylindrical housing in which the post, clicker rod, and spring are disposed, and having a plurality of grooves formed on its inside surface for engagement with the protrusions of the post and the rails of the clicker rod, the grooves comprising closed grooves, which have their lower ends closed, alternating with open grooves, which have their lower ends open. The post has an extended position in which the rails of the clicker rod are disposed in the open grooves and a retracted position in which the rails abut against the closed ends of the closed grooves.

The advantages and features of the present invention will become apparent from the following description read in conjunction with the accompanying drawings in which like reference numerals designate like elements.

DETAILED DESCRIPTION OF THE INVENTION

Figure 1:
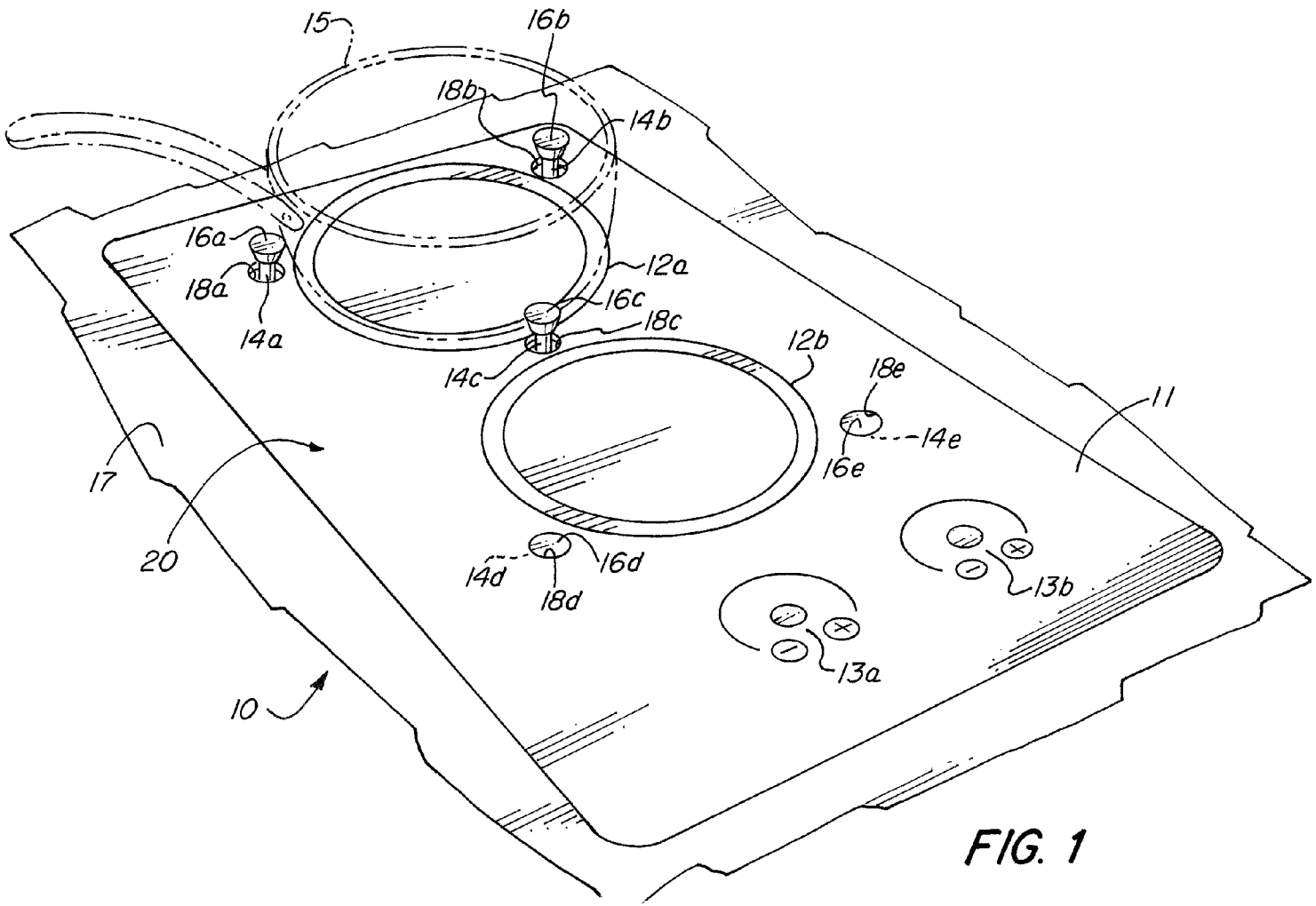
FIG. 1 is a perspective view of a safety system for a stove according to an exemplary embodiment of the present invention.

Exemplary embodiments of the present invention will now be described with reference to the accompanying drawings. FIG. 1 shows a stove 10 that includes a safety system 20 according to the present invention. The stove 10 includes a stovetop 11, which, in the embodiment shown in FIG. 1, is a substantially flat surface. The stovetop 11 includes, in this embodiment, two cooking areas 12*a* and 12*b*. A cooking vessel 15, or pot, is shown in broken lines on the cooking area 12*a*. These cooking areas are circular and are controlled by the control buttons 13*a* and 13*b*.

In the embodiment shown, the stove 10 is an induction stove, the function of which is well-known in the art. However, the present invention is advantageously applied on stoves of any type, including natural gas, electric, alcohol, combinations of these, and the like. Furthermore, the stove 10 as shown is a built-in stove which is mounted in a counter 17. The counter 17, in this embodiment, is located in an RV. As one of ordinary skill in the art will appreciate, however, the safety system 20 of the present invention is advantageously employed with stoves mounted in vehicles of all types, including boats, trucks, and the like, and as well as in portable carrying cases. The present invention is also useful in typical commercial and residential kitchens. One of ordinary skill in the art will appreciate that the present invention will improve the safety of nearly any stove installed anywhere.

The stovetop 11 is ceramic in this embodiment, but other materials are advantageously employed in other embodiments. The stovetop 11 is also substantially planar in the embodiment shown in FIG. 1, but in other embodiments portions of the stove top are recessed and/or elevated according to the particular design and installation.

Safety system 20 further comprises five retractable posts 14*a*-14*e*, which are disposed in openings 18*a*-18*e* in the stovetop surface 11. In a manner such as those described in detail below, each retractable post is independently extendable to help prevent unwanted movement of the pot 15, such as sliding. That is, all of the posts 14, none of the posts 14, or any number in between may be extended for use at any given time. There are numerous devices suitable to be used to actuate the posts 14 between the extended and retracted positions, some of which are described and shown in the present application. In general, however, each post 14 is extendable by a simple action of a user of the safety system. In some cases, the top surface of the bumper 16 must simply be depressed below the surface of the stovetop 11. In other cases, a small button that activates a pneumatic or hydraulic pump or an electric motor is all that is necessary to actuate the post 14.

Posts 14*a*, 14*b*, and 14*c* are shown in their extended positions, while posts 14*d* and 14*e* are shown in their retracted positions. Each post 14 includes a bumper portion 16, which is positioned to contact a cooking vessel, such as the pot 15. The bumpers 16 must be made out of a heat resistant material that is preferably elastomeric so as to provide a measure of shock absorption and a measure of friction against the side of a cooking vessel when the post 14 is in the extended position. This measure of shock absorption helps to limit the forces being transmitted to the stovetop 11. When the post 14 is in the retracted position, the bumper 16 seals off the respective opening 18 in the stovetop 11 to prevent leakage into the cavity beneath the stove 10.

The bumpers 16 must also be resistant to corrosion and wear from cleaning and cleaning products. Many different shapes of bumpers are employed in other embodiments, as will be appreciated by one of ordinary skill in the art, and the particular shape employed depends on the overall design of the safety system 20. In some embodiments, the post 14 and the bumper 16 are separate parts that are attached together, while in other embodiments, the post 14 and the bumper 16 are a single, unitary part.

In the exemplary embodiment shown, the retractable posts 14*a*-14*e* are arranged on the stovetop surface 11 to allow safe use of either one or two cooking vessels. The pattern formed by the posts 14 is such that the number of posts is minimized while still providing ample protection against unwanted movement of the cooking vessels. In this embodiment, five posts 14 are used, with the two cooking areas 12*a* and 12*b* sharing the center post 14*c*. In embodiments having only a single cooking area 12, only three posts are necessary. In embodiments in which three or more cooking areas 12 are used, more than five posts 14 are used.

In some embodiments of the present invention, the stove 10 may include ledges or lips near the cooking areas 12, which may provide additional protection against unwanted movement of the cooking vessels. In such cases, only two or perhaps one retractable post 14 is required to provide the necessary protection against sliding cooking vessels.

The retracted posts 14*d* and 14*e* (which are in the retracted position) depict an important and valuable capability of the safety system 20. When in the retracted position, the top surface of the posts (in this embodiment, the top surface of the bumpers) is at the level of the stovetop 11. When the two surfaces are flush in this manner, the stove 10 is exceptionally easy to clean and has an attractively uncluttered appearance.

Figure 2:
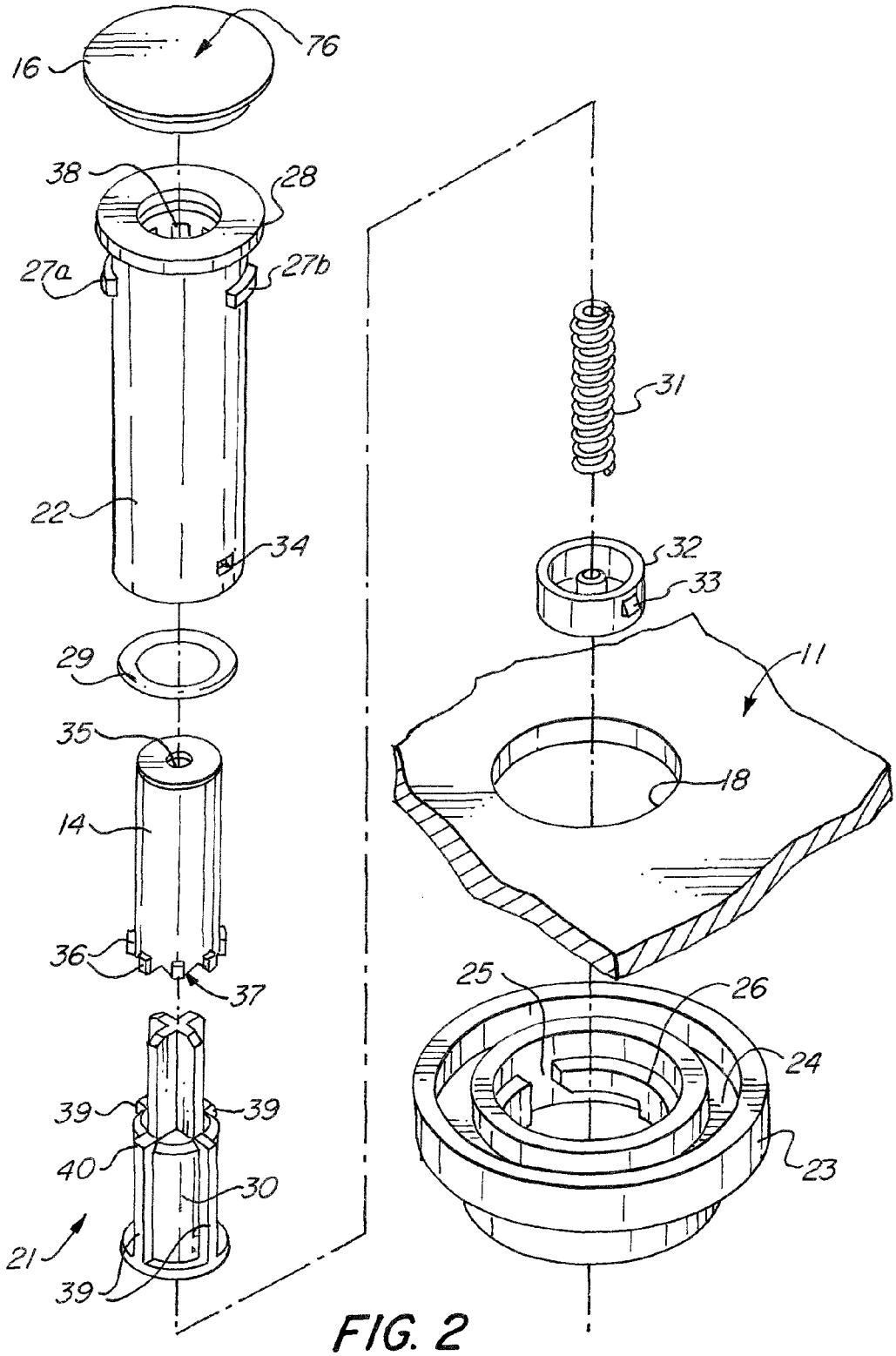
FIG. 2 is an exploded view of a device for use in the safety system of FIG. 1.

FIG. 2 shows an exploded view of a first embodiment of a device for actuating the retractable posts 14 used in the safety system 20 of FIG. 1. The device 21 is mounted in an opening 18 of the stovetop 11 via a collar 23. Collar 23 is mounted to the underside of stovetop surface 11 by adhesive or other suitable means such that the collar 23 is stationary and firmly attached. Two-sided tape is employed in some embodiments. The collar 23 includes an adhesive well 24.

Figure 7:
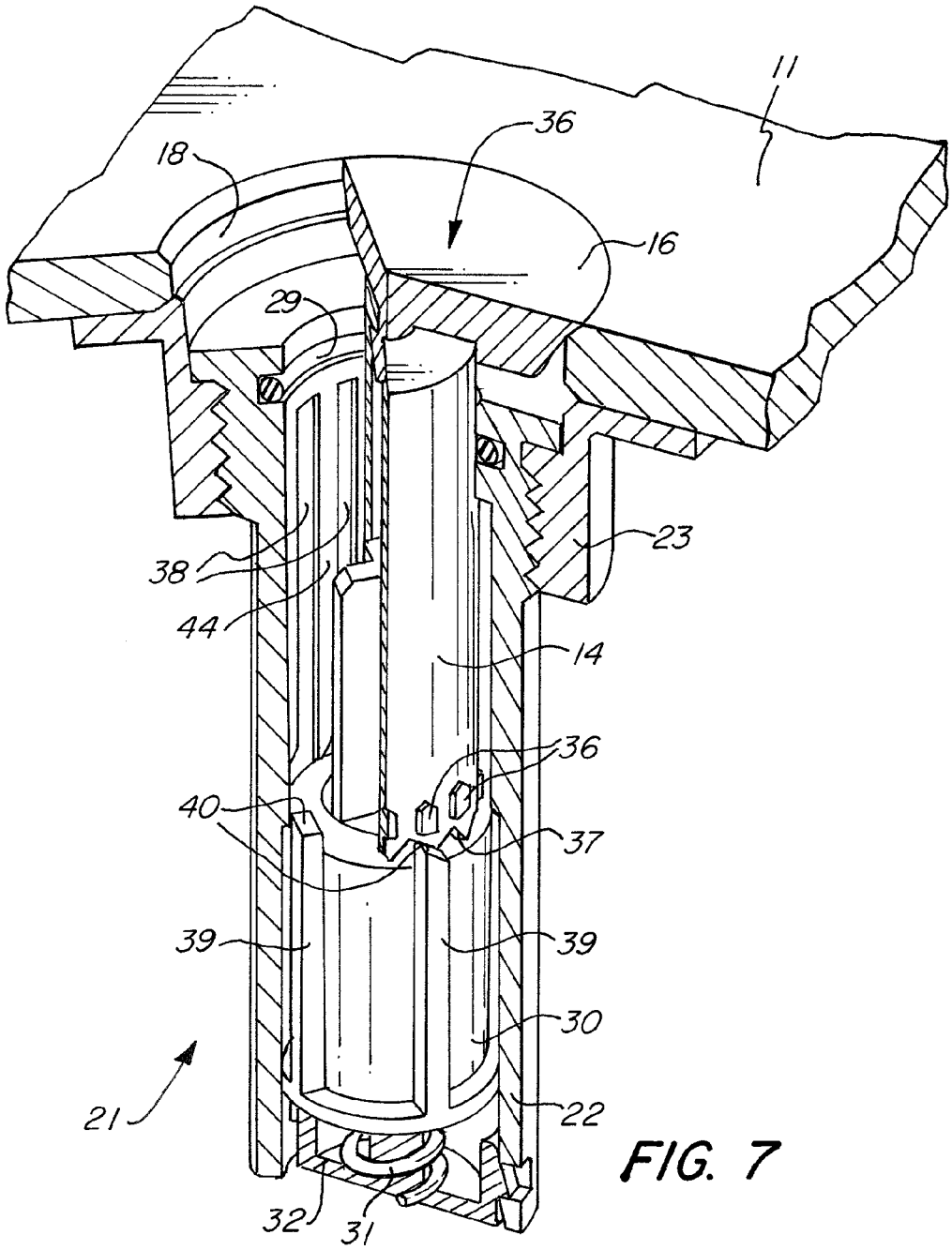
FIG. 7 is a cut-away view of the device of FIG. 2.

The housing 22, which is, in this embodiment, cylindrical, is mounted in the collar by engaging the two collar-engaging protrusions 27*a* and 27*b* against the ledge 26 on an inside diameter of the collar 23. To mount the housing 22 in the collar 23, it is dropped into the collar such that the collar-engaging protrusions 27 pass through the openings 25 (only one shown) in the ledge 26. The housing 22 is then rotated between 90° (¼ turn) and less than 180° (less than ½ turn) so that the protrusion abuts against the bottom of the ledge 26. The housing 22 is prevented from falling through the collar 23 by housing lip 28 on its top portion. In other implementations, the housing has threads on its exterior surface that engage threads on the collar. This arrangement is shown in FIGS. 3, 5, and 7, and is described below.

FIG. 2 shows the additional components of the device 21, the structure of which is important in order to understand the inner workings of the device 21. The post 14 is disposed within the housing 22 and an o-ring 29 is also disposed therein to prevent the infiltration of moisture and/or debris into the device 21. In some embodiments, instead of the o-ring 29, a rubber molded cap is used. The bumper 16 is attached to the post 14 through the hole 35 on the top portion of the post 14. The top surface 76 of the bumper 16 is the uppermost surface of the device 21 and is the surface of the device which is at or below the surface of the stovetop 11.

The post 14 is supported by a clicker rod 30 and spring 31. The spring 31 is seated on end cap 32 which snaps to the lower portion of the housing 22 using housing protrusion 33 and hole 34. The spring 31 biases the clicker rod 30 and the post 14 upwardly in the housing 22. In the embodiment shown, the spring 31 is a stainless steel coil spring. In other embodiments, other materials and/or device are employed to provide the spring bias of spring 31. For example, an elastomer or rubber piece, an elastomer or rubber band, or a leaf spring, are sometimes used. The clicker rod 30 is able to rotate relative to the post 14 and the housing 22. The post 14 has a plurality of post protrusions 36 near its lower edge 37. Further, the lower edge 37 is in the form of a zig-zag pattern. The post protrusions 36 slide in grooves 38 formed on the interior surface of the housing 22. The lower edge 37 having a zig-zag pattern engages with rails 39 formed on the clicker rod 30. In this embodiment, there are half as many post protrusions 36 as there are rails 39. In the embodiment shown, the clicker rod 30 has four rails 39 disposed at 90° increments around the circumference of the clicker rod 30. The rails 39 have top surfaces 40 that are canted, and which contact the canted surfaces of the zig-zag lower edge 37. The canted surfaces 40 are able to slide along corresponding surfaces of the zig-zag lower edge 37 in a manner described below.

Figure 3A:
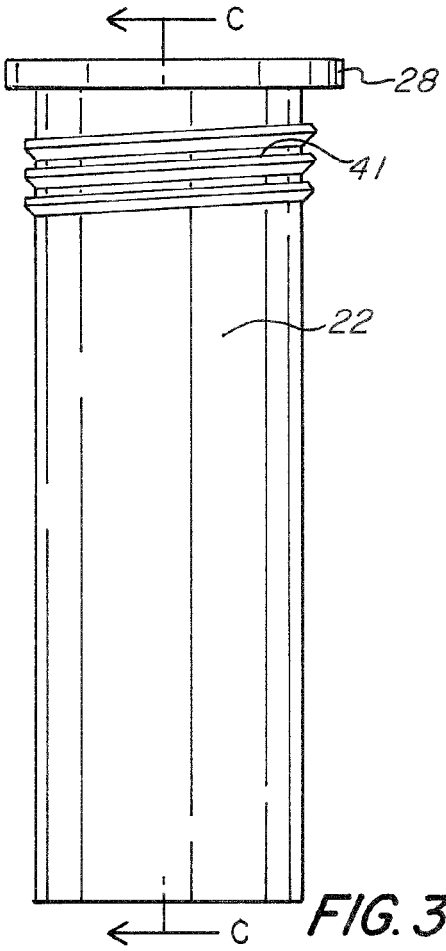
FIG. 3*a* is a side view of a cylindrical housing used in the device of FIG. 2.
Figure 3C:
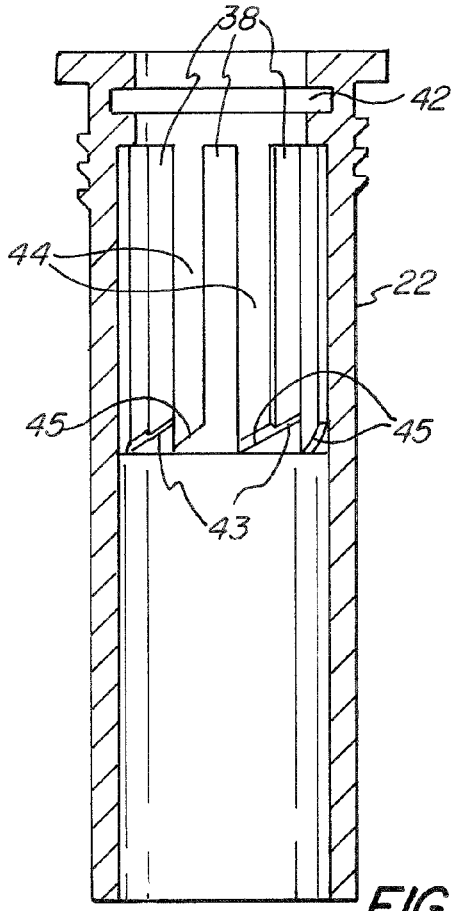
FIG. 3*c* is a cross-section view of the cylindrical housing of FIG. 3*a* taken along line C-C.
Figure 3B:
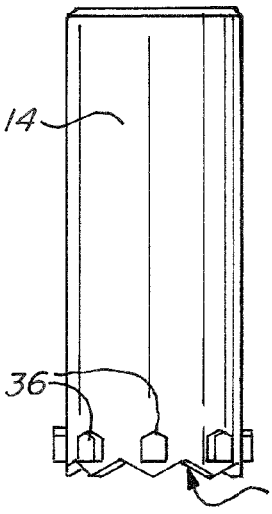
FIG. 3*b* is a side view of a post used in the device of FIG. 2.
Figure 3D:
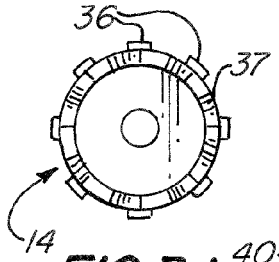
FIG. 3*d* is a bottom view of the post of FIG. 3*b*.
Figure 3E:
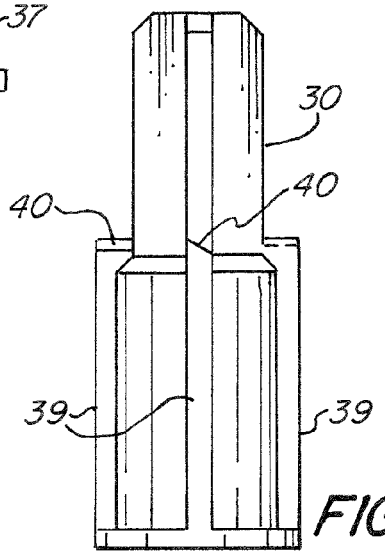
FIG. 3*e* is a side view of the clicker rod used in the device of FIG. 2.

FIGS. 3*a*-3*e* show additional details of the housing 22, the post 14, and the clicker rod 30 in accordance with the exemplary embodiment device 21. One important difference, however, is that the housing 22 shown in FIG. 3*a* includes an alternative means for mounting in the collar attached to the stovetop. This housing 22 is provided with threads 41 which engage threads on the collar. FIG. 3*b* clearly shows the post protrusions 36 and the zig-zag lower edge 37 of the post 14. FIG. 3*d*, which is a view of the bottom of post 14, shows that the protrusions 36 are disposed around the entire circumference of the post 14. The protrusions 36 are slideably disposed in the grooves 38 that are formed on the interior surface of housing 22, shown in FIG. 3*c*. The grooves 38 are formed between dividing portions 44. The surfaces of the grooves 38 are at the largest inner diameter of the housing 22, while the dividing portions 44 protrude inwardly. FIG. 3*c* also shows a disk-shaped compartment 42 that houses the o-ring 29 shown in FIG. 2.

An important aspect of the housing 22 is that alternating grooves 38 have a block 43 at their lower ends. The blocks 43 are canted at roughly the same angle as the lower ends of the dividing portions 44, which are designated by reference number 45. It is the blocks 43 and the ends 45 that are engaged by the canted surfaces 40 of the rails 39 formed on the clicker rod 30, shown in detail in FIG. 3*e*. In essence, closed end and open end grooves alternate around the inner surface of the housing 22. A post protrusion 36 is disposed in each groove, whether closed or open at its lower end. On the other hand, the rails 39 of the clicker rod 30 are only permitted to enter the open-end grooves.

FIGS. 4*a*-4*e* show a schematic representation of the components of the device 21 in order to illustrate the function of this embodiment of the present invention. FIGS. 4*a*-4*e* show the device at various positions as the post 14 is moved from its extended position, through its recessed position, and to its retracted position. The relevant parts of the device 21 are designated by the reference numbers from previous figures, but, to improve clarity, unnecessary reference numbers are not repeated in all of the schematic FIGS. 4*b*-4*e*.

Figure 4A:
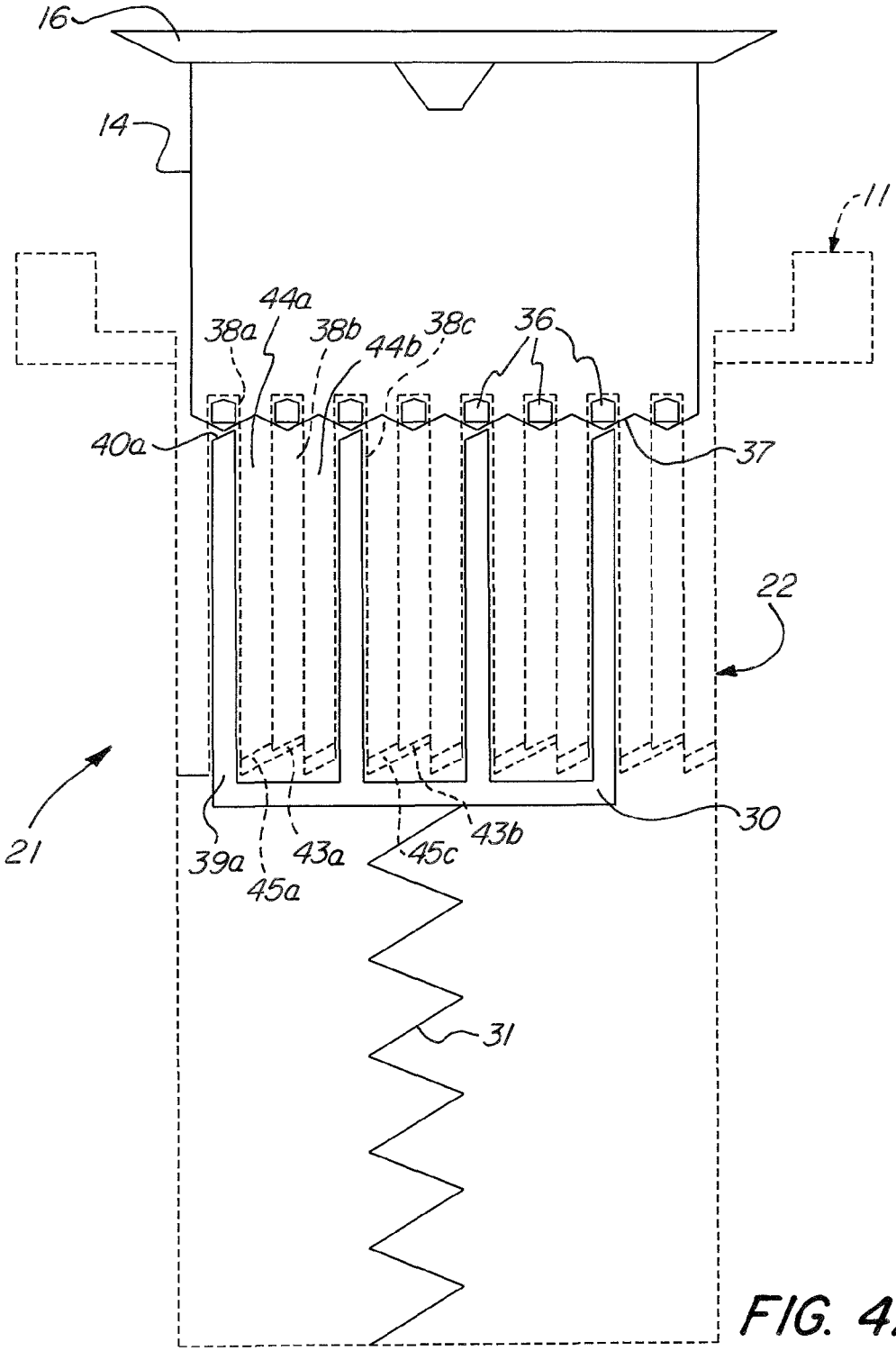
FIG. 4*a* is a schematic view of the device of FIG. 2 in an extended position.

In FIG. 4*a*, the post 14 is in the extended position, with bumper 16 attached to its top portion. The dotted lines are the housing 22 and the rails 39 of the clicker rod 30 are shown. As the various positions of the device are described, the reader's attention will be directed to the position of rail 39*a*. In FIG. 4*a*, rail 39*a* is disposed in groove 38*a*, with canted surface 40*a* abutting against the zig-zag edge 37 of the post 14. Indeed, all of the rails 39 of the clicker rod 30 are supporting the post 14 in all of its positions. The spring 31 is shown providing an upward bias against the clicker rod 30. Thus, when a downward force is applied to the post 14 and/or bumper 16, the post 14 and bumper 16 will slide downward in the housing 22 so long as the downward force exceeds that of the force applied upwardly by the spring 31.

Figure 4B:
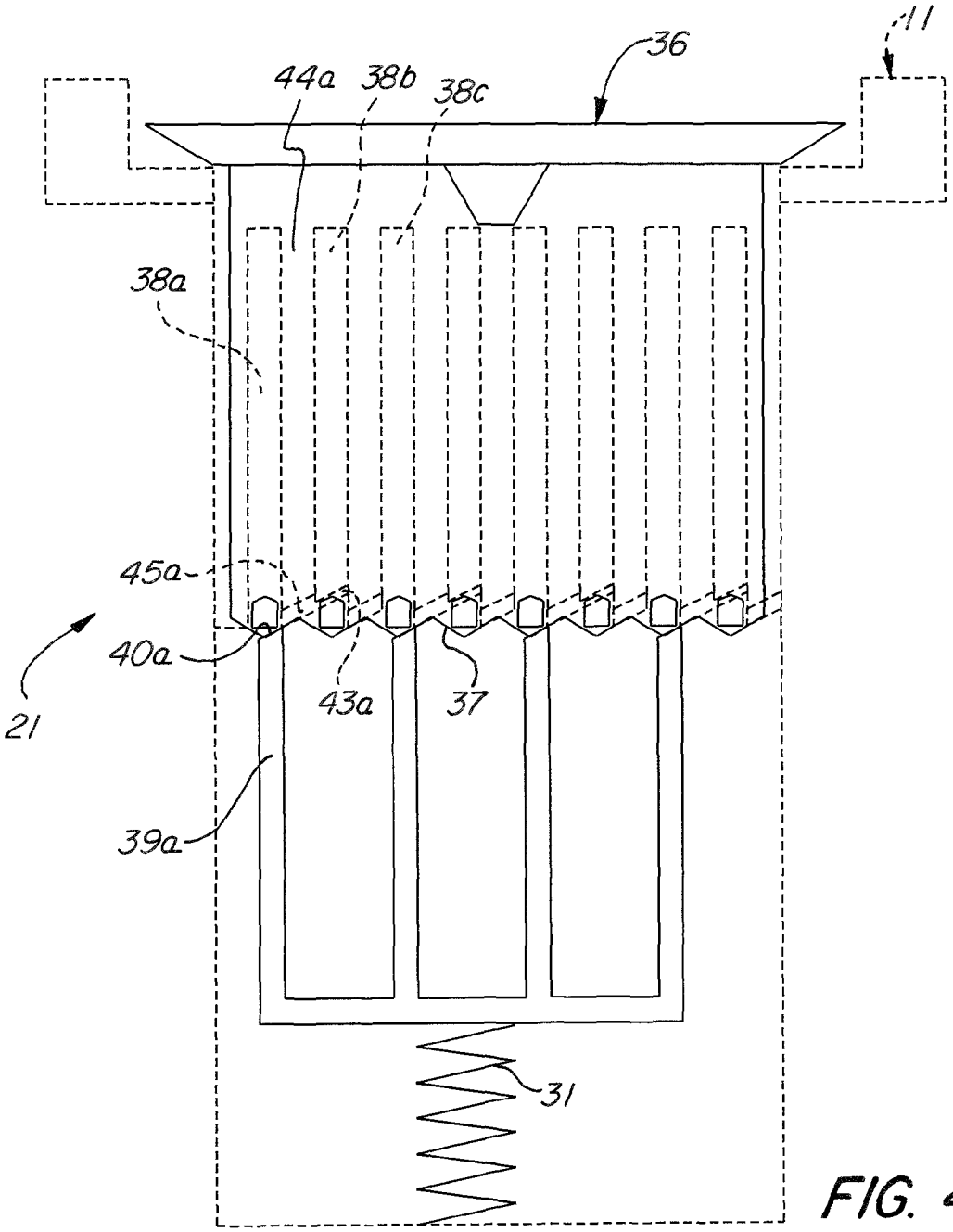
FIG. 4*b* is a schematic view of the device of FIG. 2 in a recessed position between the extended position and the retracted position.

In the event that an individual wishes to move the post 14 into its retracted position, he or she must apply a downward force to the post 14 and/or bumper 16 to move the post 14 into its recessed position. This will allow the post 14 to move into the locked, retracted position. FIG. 4*b* shows the post 14 in the recessed position between the extended position and the retracted position. The top surface 76 is pushed downward by the individual until it is below the level of the stovetop 11. This compresses the spring 31 and allows the canted surfaces 40 (in particular 40*a*) to clear the bottom (lower end 45*a*) of the dividing portions 44 (in particular 44*a*.) Once this occurs, the canted surface 40*a* will slide down a portion of the zig-zag edge 37 and toward the block 43*a*. This is possible because the clicker rod 30 is rotatably disposed in the housing and the spring 31 urges it in that direction.

Figure 4C:
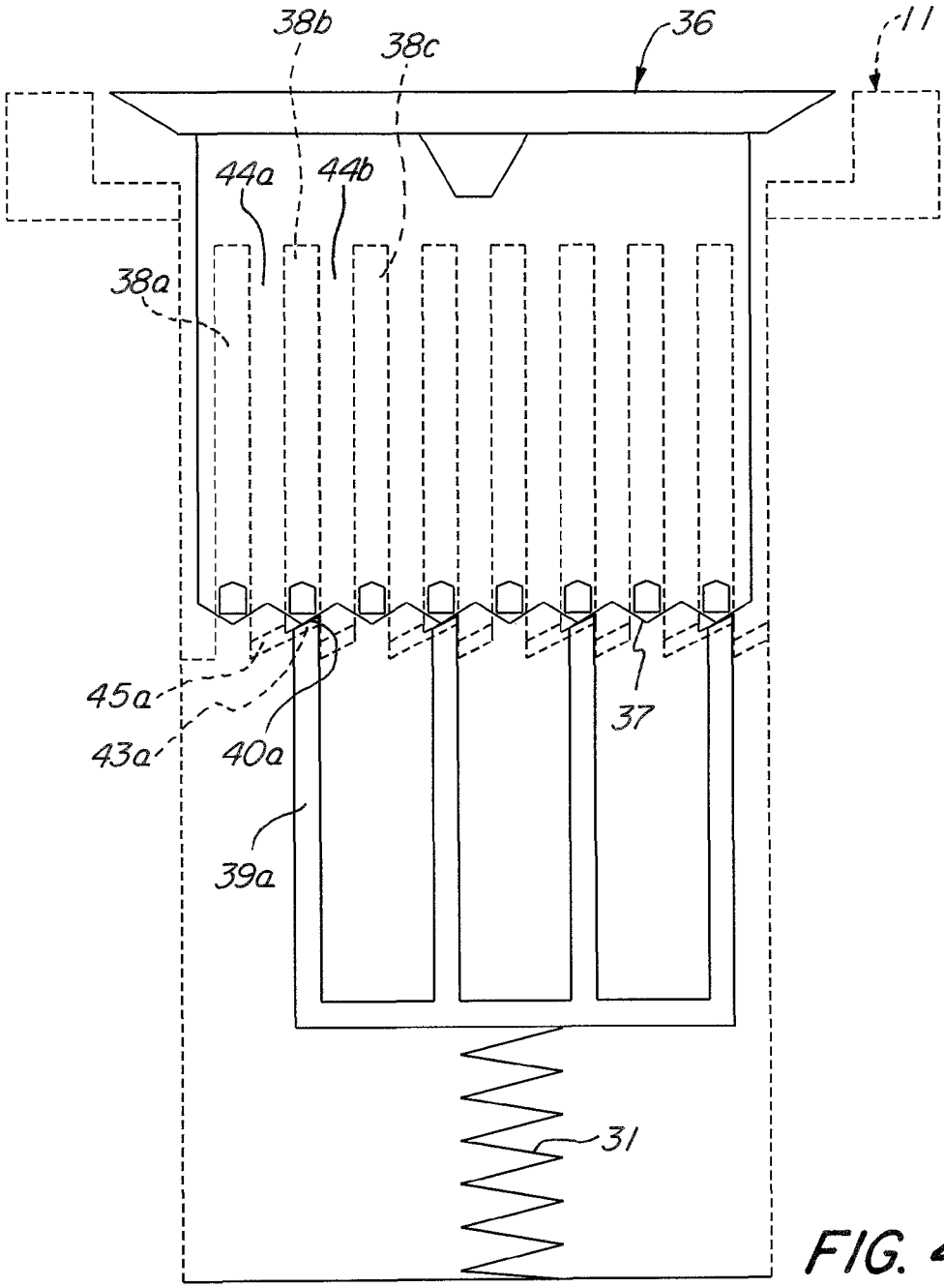
FIG. 4*c* is a schematic view of the device of FIG. 2 in a retracted position.

FIG. 4*c* shows the device 21 with the post 14 in the retracted position, after having been moved into the recessed position shown in FIG. 4*b*. In the retracted position, the top surface 76 of the bumper 16 is at the level of the stovetop 11. In most embodiments, the size of the bumper 16 is selected to completely fill the opening in the stovetop 11 so as to seal the opening against fluids and debris. The rail 39*a* has been rotated so that the canted surface 40*a* abuts against the block 43*a*, which is located at the lower end of groove 38*b*. From the recessed position, the canted surface 40*a* slid down the lower end 45*a*, which is also canted, until it came to rest against block 43*b*, all while the clicker rod 30 rotates in the housing 22. It will be understood by one of ordinary skill in the art that the rails 39 are wide enough to both support the post 14 and to interact with the lower ends 45 and blocks 43. This is depicted in FIG. 7. Also, the post protrusions 36 are designed to not interact with the blocks 43, which can be accomplished by their location on the post 14 or a difference in diameter.

Figure 4D:
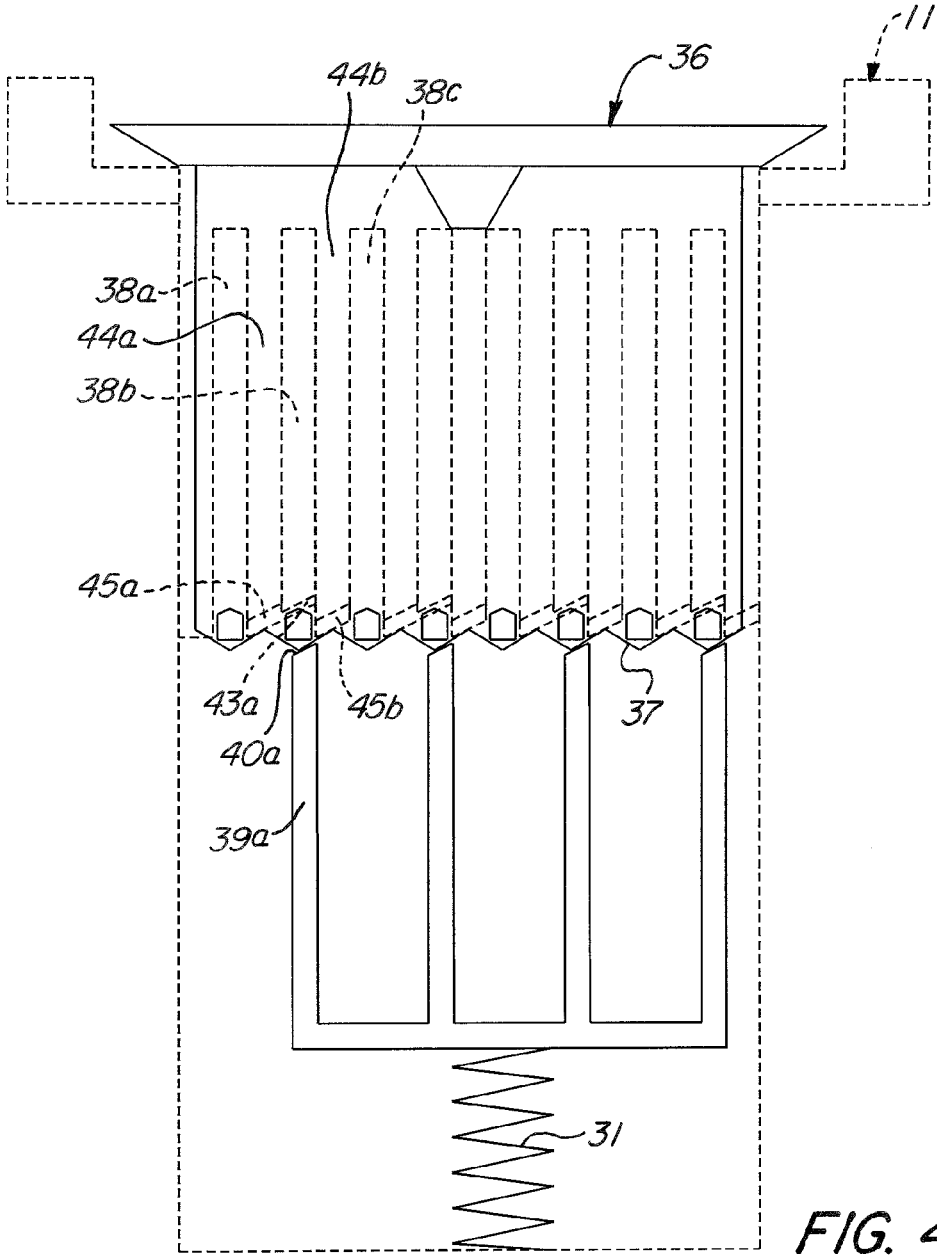
FIG. 4*d* is a schematic view of the device of FIG. 2 in a recessed position between the retracted position and the extended position.

In the event that an individual wishes to return the device 21 to the state in which the post 14 is in the extended position, he or she must again move the post 14 into the recessed position. This will cause a further rotation of the clicker rod 30 within the housing 22. FIG. 4*d* shows the post in the recessed position. The clicker rod 30 is again forced downwardly until the canted surface 40*a* clears the lower end 45*b* of the dividing portion 44*b*. Once this occurs, the canted surface 40*a* will slide across the lower end 45*b* and be forced into the groove 38*c*. Again, the clicker rod 30 is caused to rotate relative to the post 14 and the housing 22 because of the interaction of the canted surface 40*a* with the zig-zag lower end 37 of the post 14.

Figure 4E:
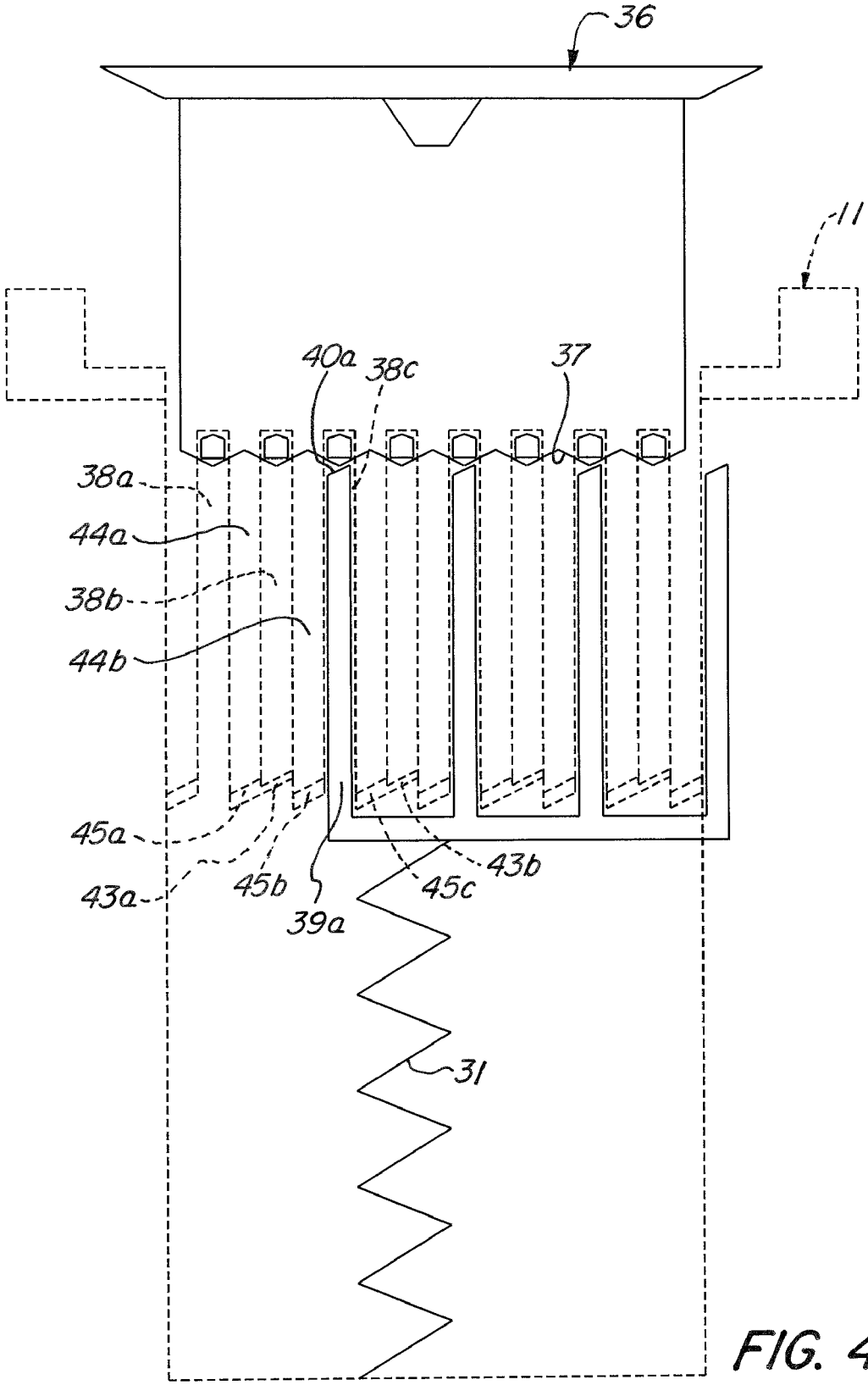
FIG. 4*e* is a schematic view of the device of FIG. 2 in an extended position.

FIG. 4*e* shows the post 14 returned to the extended position after being in the recessed position of FIG. 4*d*. The rail 39*a* has now been moved into the groove 38*c*, so that the rail 39*a* supports the post 14 in its extended position, where top surface 76 is above the stovetop 11. To move the post 14 back to the retracted position, a downward force is applied which causes the rails to clear the lower ends (particularly 45*c*) of the dividing portions, and the canted surface 40*a* would eventually come to rest, abutting against block 43*b*.

The foregoing is a description of the function of device 21, which is only one embodiment of the present invention. In this embodiment, the posts 14 are easily and quickly deployed into their extended positions by simply pressing the post 14 downward with a finger. Each time the post 14 is moved into its recessed position, the clicker rod 30 rotates a discrete amount to engage either blocks 43 or enter the grooves 38. Each device 21 is independently operable, so that any number of devices installed in the stove 10 may be put into extended positions for use.

Figure 5B:
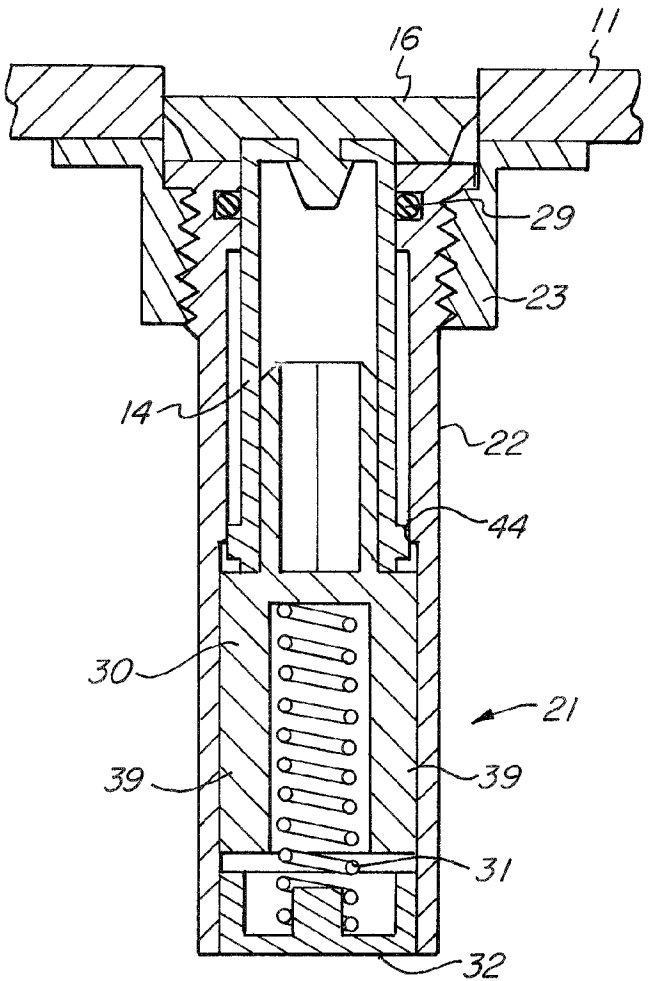
FIG. 5*b* is a cross-section view of the device of FIG. 2 in a recessed position.
Figure 5A:
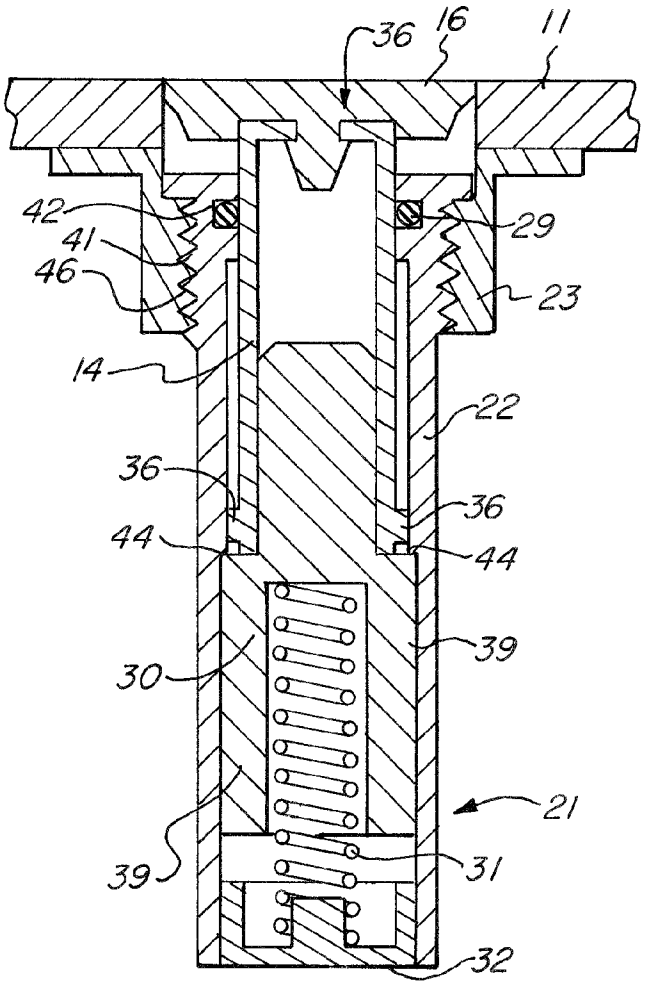
FIG. 5*a* is a cross-section view of the device of FIG. 2 in a retracted position.
Figure 5D:
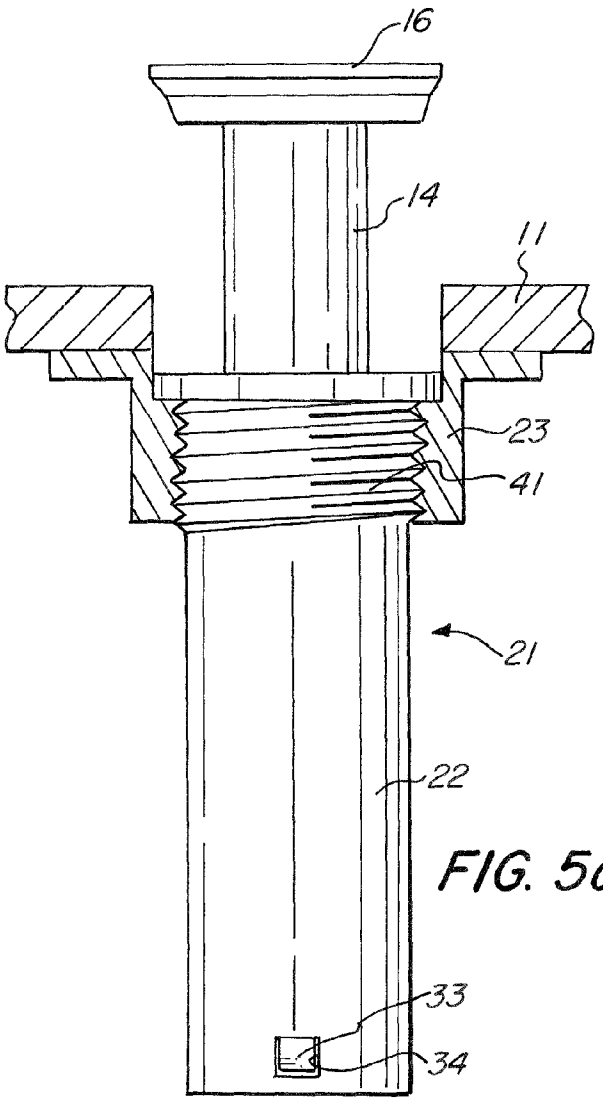
FIG. 5*d* is a side view of the device of FIG. 2 in an extended position.
Figure 5C:
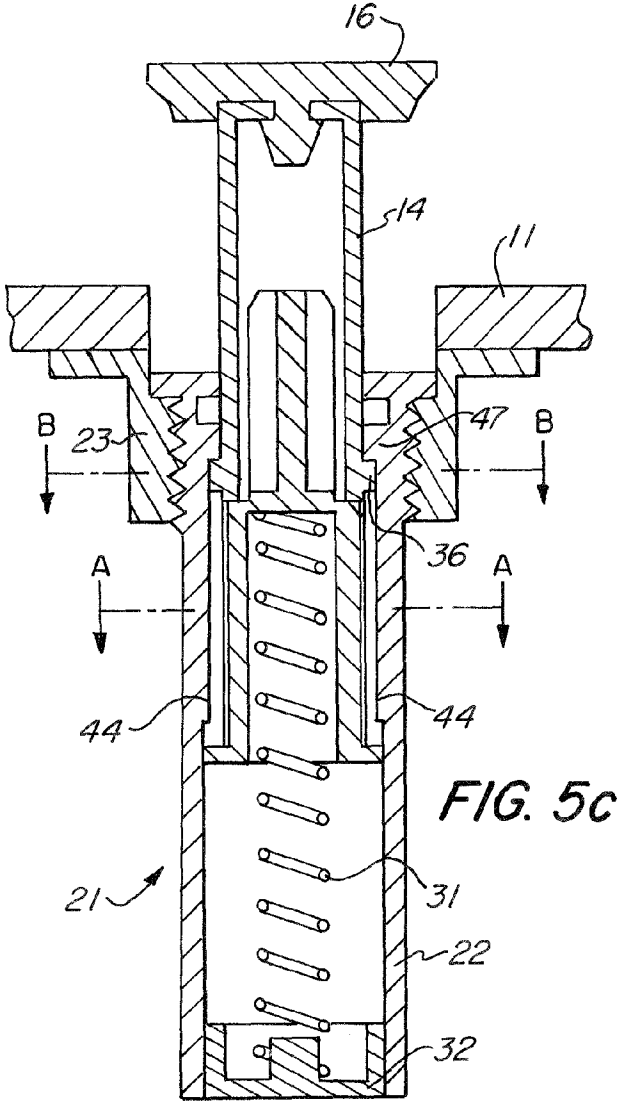
FIG. 5*c* is a cross-section view of the device of FIG. 2 in an extended position.

FIGS. 5*a*-5*c* show the device 21 in cross-section in each of the positions shown schematically in FIGS. 4*a*-4*e*: retracted (FIG. 5*a*), recessed (FIG. 5*b*), and extended (5*c*). In the device 21 shown in FIGS. 5*a*-5*c*, the housing 22 is mounted to the collar 23 by threads 41 of the housing engaging with thread 46 of the collar. The collar 23 is mounted to the stovetop 11. In FIG. 5*a*, the post 14 is in the retracted position, in which the top surface 76 of the bumper 16 is at the level of the stovetop 11. The o-ring 29 is shown disposed in the disk-shaped compartment 42. The o-ring 29 serves to prevent leakage when the post 14 is in the extended position (i.e., when the bumper 16 does not perform its function of sealing the opening 18). In this cross-section view of the housing 22, dividing portions 44 are shown in that the inner diameter of the housing is smaller in the upper portion than in the lower portion. The rails 39 of the clicker rod 30 are shown abutting against the lower ends of the dividing portions 44. The spring 31 biases the clicker rod 30, post 14, and bumper 16 upwardly. End cap 32 closes the bottom opening of the housing 22.

FIG. 5*b* shows the device 21 when the post 14 is in the retracted position. Spring 31 is slightly more compressed, bumper 16 is below the surface of 11, and consequently post 14 and clicker rod 30 are at lower positions within the housing 22.

FIGS. 5*c* and 5*d* show the device 21 with the post in the extended position, where FIG. 5*c* shows it in cross-section. The clicker rod 30 has been rotated by the canted surfaces and the force of the spring 31, so rails 39 are not visible in this cross-section view. The post protrusions 36 abut against retention lip 47 to hold the post 14 in the housing 22 against the force of the spring 31. The side view of FIG. 5*d* shows more clearly the threads 41 and the protrusion 33 and hole 34 for holding the end cap 32 on the bottom of the housing 22.

Figure 6A:
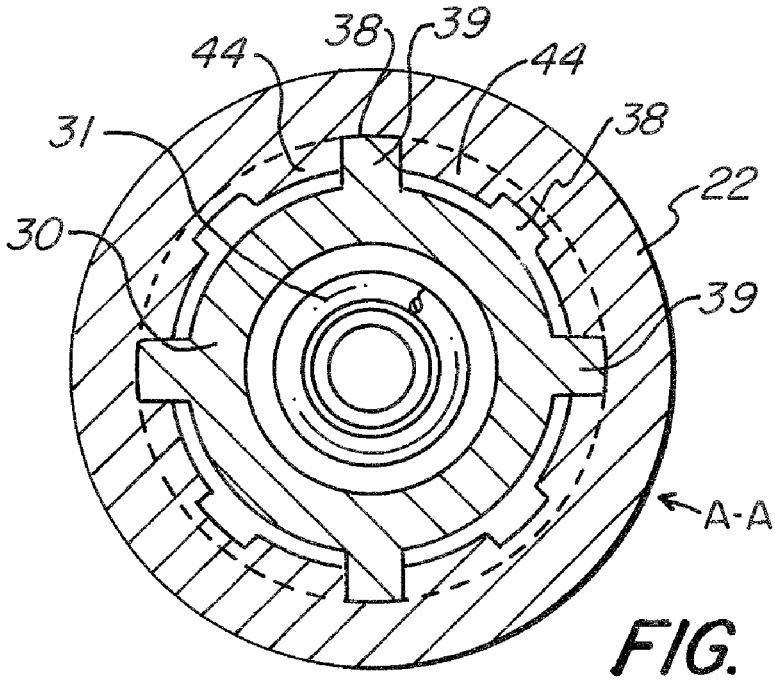
FIG. 6*a* is a cross-section view taken along line A-A in FIG. 5*c*.
Figure 6B:
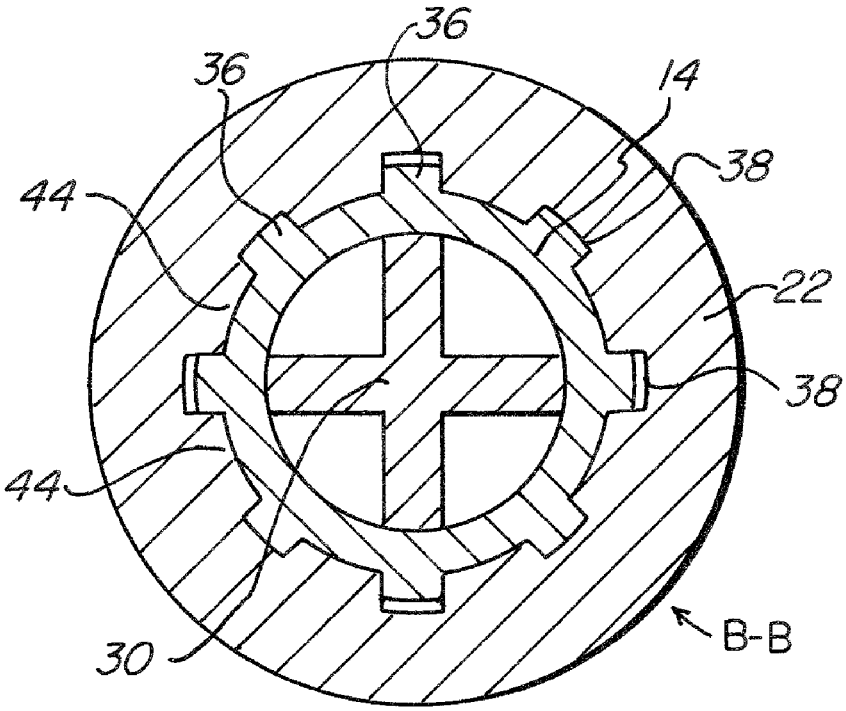
FIG. 6*b* is a cross-section view taken along line B-B in FIG. 5*c*.

FIGS. 6*a* and 6*b* show cross-section views of the device 21 taken along lines A-A and B-B shown in FIG. 5*c*, respectively. Along line A-A, the rails 39 are shown disposed in the grooves 38 of the housing 22. The dividing portions 44 separate the grooves 38. In FIG. 6*b* along line B-B, the protrusions 36 of post 14 are disposed in the grooves 38 of the housing 22. The top portion of the clicker rod 30 is shown, and has a cross-shape as also shown in FIG. 2.

FIG. 7 shows a detailed cut-away view of the device 21 for use with the safety system 10 according to this exemplary embodiment of the present invention. The post 14 is in the retracted position so that the top surface 76 of the bumper 16 is at the level of the stovetop 11. The engagement between the canted surfaces 40 of the rails 39 and the zig-zag edge 37 of post 14 is shown in particular detail. It is clear that the canted surface 40 extends outward from the zig-zag lower end 37, and that this outward extension engages the lower ends 45 and blocks 43 of the dividing portions 44 and grooves 38.

The components of the above-described embodiment are preferably made of the same materials to avoid issues associated with differing growth and shrink rates over the wide temperature range to which the components are subjected by the stove 10. This is not necessary, however, as a variety of materials may be employed in a single device so long as they have similar reactions to temperature or any difference in reactions is accounted for in the design. In the embodiment described, the parts of the device 21 are injection molded out of heat tolerant plastics, such as Polyphenylene sulfide ("PPS"), Polyphthalamide ("PPA"), Nylon, etc. Metal or certain ceramics are used in other embodiments, and one of ordinary skill in the art will understand that the selection of materials will depend on the particular design of the system. Other manufacturing processes are employed in other embodiments, such as machining, rotomolding, and the like.

The device 21 is easily removable from the stovetop 11 for cleaning or repair. Both the attachment means described and shown herein (i.e., in FIG. 2 (comprising the collar-engaging protrusions 27 on the housing and ledge 26 on the collar) and in FIGS. 3, 5, and 7 (comprising a threaded connection)) allow the user of the system to easily remove the device 21 from the stovetop 11.

Figure 8:
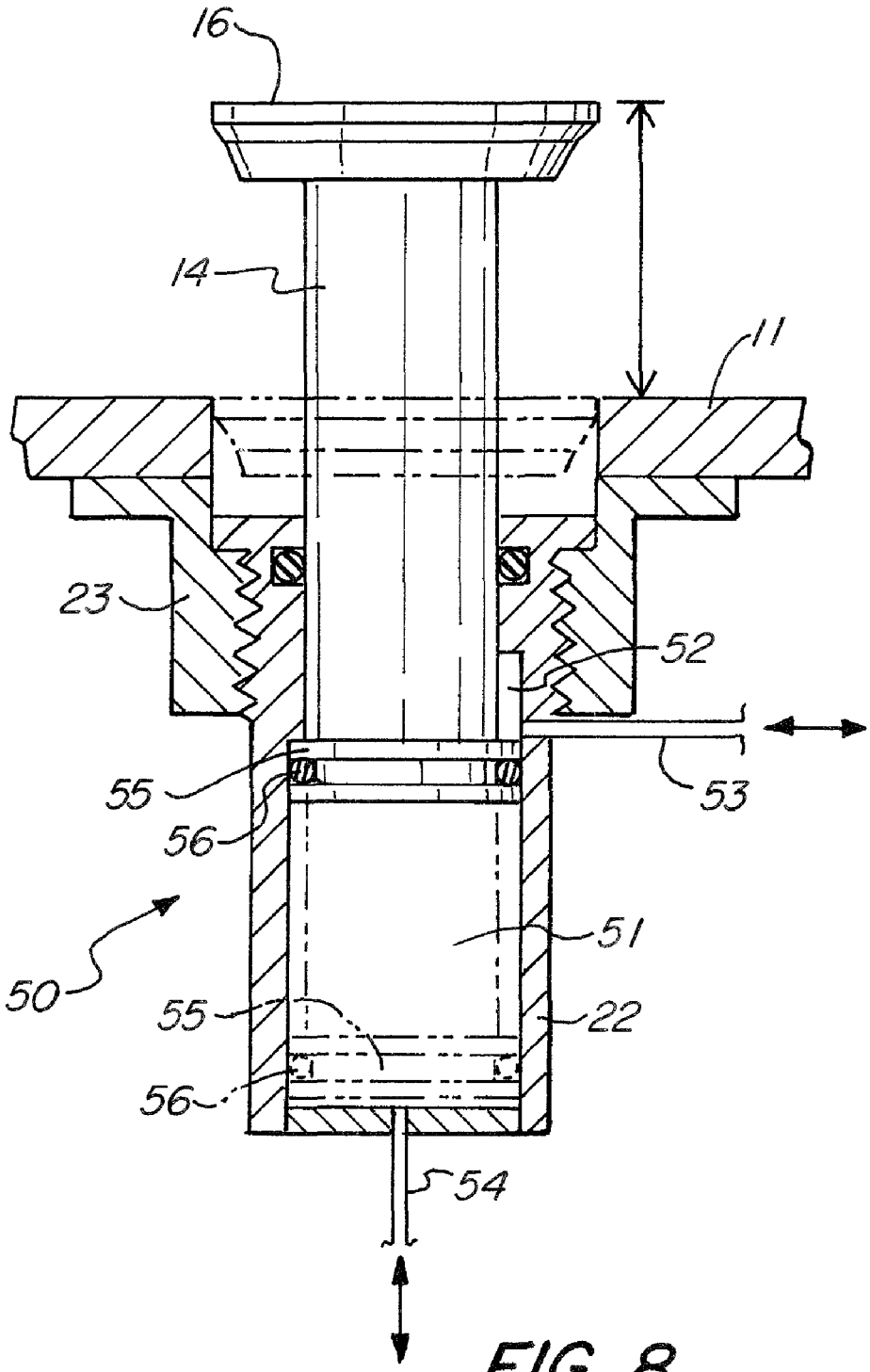
FIG. 8 is a cross-section view of a device according to a second embodiment of the present invention for use in the safety system of FIG. 1.

In other embodiments, the post 14 is actuated between the extended and retracted positions pneumatically, hydraulically, or electrically. FIG. 8 shows device 50 which utilizes either pneumatics or hydraulics to actuate the post 14. In this embodiment, the housing 22 includes two chambers 51 and 52 for receiving pressurized fluid (either gas or liquid). Chamber 51 is connected via inlet 54 to a source of pressurized fluid (not shown). Chamber 52 is also connected, via inlet 53, to a source of pressurized fluid, which, in many embodiments, is the same source connected to chamber 51. The post 14 has on its lower end a piston 55 which moves within the housing 22. Seal 56 is provided to pneumatically (or hydraulically) isolate the chambers 51 and 52 from one another. When the post 14 is desired to be in the extended position, chamber 51 is supplied with pressurized fluid to force the piston 55 and post 14 upward in the housing. To return the post to the retracted position (shown in broken lines), the chamber 52 is provided with pressurized fluid while the chamber 51 is evacuated to allow the piston 55 and post 14 to lower within the housing. An upward bias is created by pressurizing the chamber 51.

A further embodiment of a device for raising and lowering posts 14 includes a mechanical lever placed over the post 14 to prevent it from extending. A hidden slot is disposed approximately perpendicular to post 14. Post 14 is turned and held within the slot in a recessed position and turned in an opposite direction to release post 14 from the recessed position.

Figure 9:
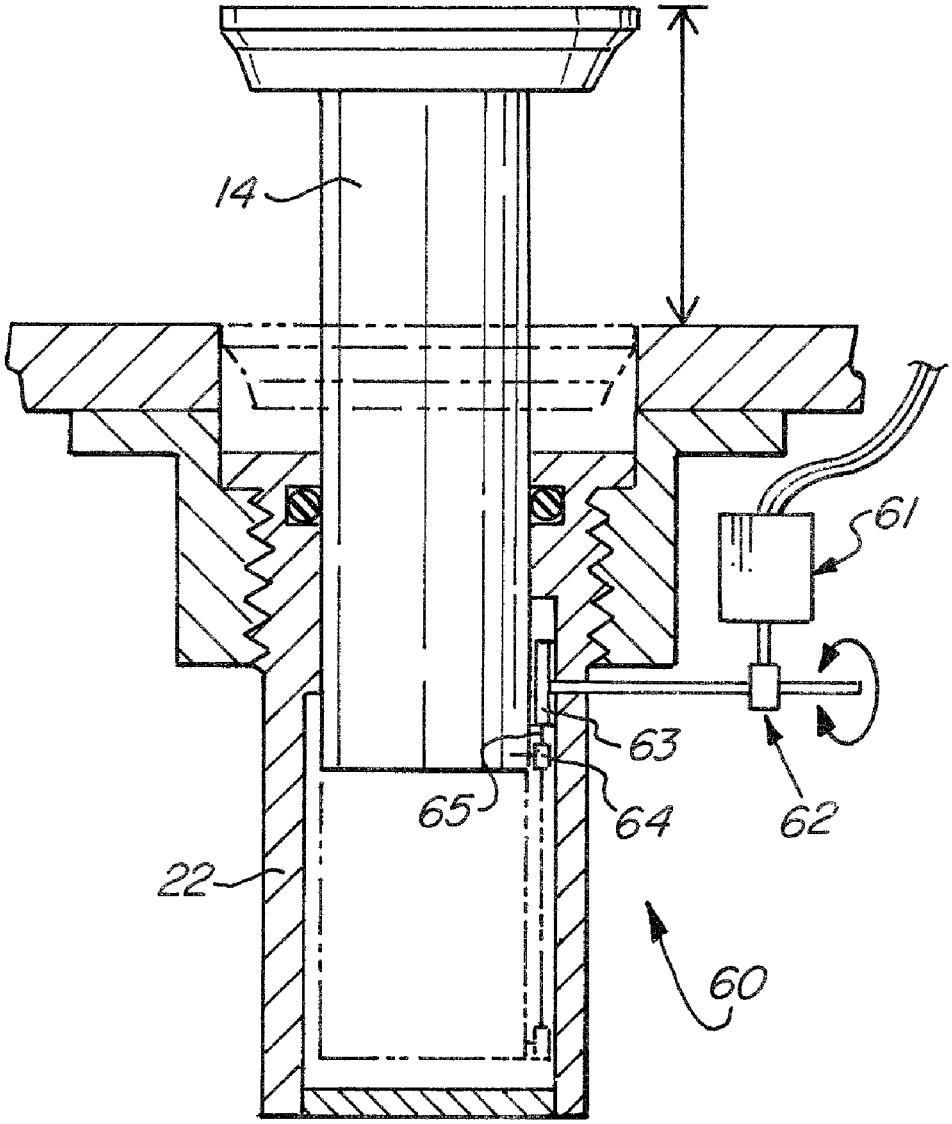
FIG. 9 is a cross-section view of a device according to a third embodiment of the present invention for use in the safety system of FIG. 1.

Finally, FIG. 9 shows an embodiment of the present invention in which an electric motor 61 is used to raise and lower post 14. The motor 61 is attached to a shaft 62 which has a beltwheel 63 on its end that is disposed in the housing 22. The post 14 has an anchor 64 attached on its bottom portion to which belt 65 is attached. Belt 65 is wound around beltwheel 63 such that when beltwheel 63 is rotated, the belt 65 is either paid out or wound in to raise or lower the post 14. An upward bias is created by, for example, use of a spring and a locking mechanism as is well known in the art.

Having described specific exemplary embodiments of the invention with reference to the accompanying drawings, it is to be understood that the invention is not limited to those precise embodiments and that various changes and modifications may be effected therein by one skilled in the art without departing from the scope or spirit of the invention as defined in the appended claims.

What is claimed is:

1. An apparatus for reducing unwanted movement of a cooking vessel, comprising:

a stovetop surface having an opening;

a retractable post;

wherein the post has an extended position in which a top surface associated with the post is elevated above the stovetop surface and a retracted position in which the top surface is at or below the stovetop surface; and wherein the post is biased into the extended position and the retracted position, and wherein the post is moved from the extended position to the retracted position and from the retracted position to the extended position by first moving the post into a recessed position, in which the top surface is lower than in the retracted position.

2. The apparatus of claim 1, wherein the post is biased by a spring element.

3. The apparatus of claim 2, further comprising:

a cylindrical housing in which the post is slideably disposed and which is mounted in the opening;

a clicker rod rotatably disposed in said housing, supporting the post and having a plurality of rails, each rail having a top canted surface; and wherein the spring element pushes upward on said clicker rod which in turn pushes upward on said post;

and wherein the canted surfaces and the force of the spring cause the clicker rod to rotate a selected discrete amount when the post is moved into the recessed position.

4. The apparatus of claim 3, wherein the post has a plurality of protrusions adjacent its lower edge and a zig-zag pattern on its lower edge that engages the canted surfaces of the plurality of rails; and wherein the cylindrical housing has a plurality of grooves formed on its inside surface for engagement with the protrusions of the post and the rails of the clicker rod, the grooves comprising closed grooves, having their lower ends closed, alternating with open grooves, having their lower ends open; and wherein the rails, with each discrete rotation, alternate between abutting against the closed grooves to establish the retracted position and sliding into the open grooves to establish the extended position.

5. The apparatus of claim 3, wherein the cylindrical housing includes a threaded portion on its outside surface for engagement with threads connected to the stovetop surface.

6. The apparatus of claim 5, wherein the threads are formed on a collar that is attached to the stovetop surface.

7. The apparatus of claim 3, wherein the cylindrical housing includes two protrusions for engagement with ledges formed on a collar that is attached to the stovetop surface.

8. The apparatus of claim 1, further comprising a bumper formed of a heat resistant elastomeric material attached to the top portion of the post, on which the top surface is disposed and which contacts the cooking vessel.

9. A system for reducing unwanted movement of at least one cooking vessel on a stovetop, comprising:

a stovetop surface having a cooking area and a plurality of openings proximate the cooking area;

a plurality of retractable posts, each disposed in one of the plurality of openings; and wherein each post has an extended position and a retracted position, such that when each post is in the extended position, a top surface of the post is elevated above the stovetop surface such that the post may contact at least one cooking vessel and when the post is in the retracted position, the top surface of the post at or below the stovetop surface; and wherein each post is movable between its extended position and retracted position independently of any other post, and wherein each post is moved from the extended position to the retracted position and from the retracted position to the extended position by moving the post into a recessed position, in which the top surface of the post is below the stovetop surface.

10. The system of claim 9, wherein each post is biased in the extended and retracted positions.

11. The system of claim 9, wherein each post is slideably disposed in a cylindrical housing, each of which is mounted in an opening in the stovetop surface;

wherein a clicker rod is rotatably disposed in each housing, supporting each post and having a plurality of rails, each rail having a top canted surface;

wherein a spring force pushes upward on said clicker rod which in turn pushes upward on said post; and wherein the canted surfaces and the force of the spring cause the clicker rod to rotate a selected discrete amount when the post is moved into the recessed position.

12. The system of claim 11, wherein each post has a plurality of protrusions adjacent its lower edge and a zig-zag pattern on its lower edge that engages the canted surfaces of the plurality of rails; and wherein each cylindrical housing has a plurality of grooves formed on its inside surface for engagement with the protrusions of each post and the rails of each clicker rod, the grooves comprising closed grooves, having their lower ends closed, alternating with open grooves, having their lower ends open; and wherein the rails, with each discrete rotation, alternate between abutting against the closed grooves to establish the retracted position and sliding into the open grooves to establish the extended position.

13. The system of claim 9 wherein the top surface is on an elastomeric bumper disposed on the top of the post, and the bumper contacts the at least one cooking vessel.

14. The system of claim 9, wherein the stovetop surface comprises three or more openings disposed around the cooking area, and wherein a retractable post is disposed in each opening.

15. The system of claim 9, wherein the cooking area is a first cooking area and the stovetop surface further comprises a second cooking area, and wherein the stovetop surface comprises five openings disposed around the cooking areas, and wherein a retractable post is disposed in each opening.

16. The system of claim 9, wherein each post is supported by an expandable chamber which is connected to a fluid source, and the post is moved from the retracted position to the extended position as a result of an increase in pressure within the expandable chamber.

17. The system of claim 9, further comprising a plurality of electric motors, wherein each electric motor is used to move one of the plurality of posts back and forth between the retracted position and the extended position.

18. The system of claim 9, where the top surface of the post has substantially the same size and shape of the opening in the stovetop surface, such that when the post is in the retracted position, the stovetop surface and the top surface of the post form a substantially continuous plane.

19. A device for mounting in an opening in a stovetop surface for reducing unwanted movement of a cooking vessel, comprising:

a retractable post, having a zig-zag pattern on its lower edge and a plurality of protrusions adjacent the lower edge;

a clicker rod, supporting the post and having a plurality of rails, each rail having a top canted surface that engages the zig-zag pattern of the lower edge of the post;

a spring, providing an upward force on the clicker rod and the post; and a cylindrical housing in which the post, clicker rod, and spring are disposed, and having a plurality of grooves formed on its inside surface for engagement with the protrusions of the post and the rails of the clicker rod, the grooves comprising closed grooves, which have their lower ends closed, alternating with open grooves, which have their lower ends open; and wherein the post has an extended position in which the rails of the clicker rod are disposed in the open grooves and a retracted position in which the rails abut against the closed ends of the closed grooves.

* * * * *